US010246381B2

(12) United States Patent
Dejeaifve et al.

(10) Patent No.: US 10,246,381 B2
(45) Date of Patent: Apr. 2, 2019

(54) STABILIZED NITROCELLULOSE-BASED PROPELLANT COMPOSITION

(71) Applicant: PB CLERMONT SA, Engis (BE)

(72) Inventors: Alain Dejeaifve, Engis (BE); Vincent Berton, Engis (BE); Rowan Dobson, Engis (BE)

(73) Assignee: PB CLERMONT SA, Engis (BE)

( * ) Notice: Subject to any disclaimer, the term of this patent is extended or adjusted under 35 U.S.C. 154(b) by 50 days.

(21) Appl. No.: 15/026,627

(22) PCT Filed: Oct. 1, 2014

(86) PCT No.: PCT/EP2014/071041

§ 371 (c)(1),
(2) Date: Apr. 1, 2016

(87) PCT Pub. No.: WO2015/049286

PCT Pub. Date: Apr. 9, 2015

(65) Prior Publication Data

US 2016/0236998 A1 Aug. 18, 2016

(30) Foreign Application Priority Data

Oct. 2, 2013 (GB) ..... 1317423.0

(51) Int. Cl.
*D03D 23/00* (2006.01)
*C06B 25/26* (2006.01)
(Continued)

(52) U.S. Cl.
CPC ..... *C06B 25/26* (2013.01); *C06B 23/006* (2013.01); *C06B 25/20* (2013.01); *C06B 31/26* (2013.01)

(58) Field of Classification Search
USPC ..... 149/65, 88, 96, 97, 108.8
See application file for complete search history.

(56) References Cited

U.S. PATENT DOCUMENTS 5,459,173 A * 10/1995 Glaser ..... C08G 75/045 522/180

FOREIGN PATENT DOCUMENTS

EP 1518916 A1 3/2005
EP 1847589 A1 10/2007

OTHER PUBLICATIONS

Wilker, Stephan, et al., "Stability Analysis of Propellants Containing New Stabilizers—part IV: are phenols a possible alternative to aromatic amines?", Fraunhofer-Institut fuer Chemische Technologie, Apr. 26, 2007, Swisttal, Germany.

(Continued)

*Primary Examiner* — James E McDonough
(74) *Attorney, Agent, or Firm* — Norris McLaughlin, P.A.

(57) ABSTRACT

The present invention concerns a nitrocellulose-based propellant composition comprising:

(a) a nitrate ester based propellant consisting of nitrocellulose alone (single base) or in combination at least with a blasting oil (double or higher base); and (b) a stabilizer consisting of a general formula (I):

(I)

Wherein the stabilizer combines efficient, long term stability of the nitrocellulose-based propellants composition without (Continued)

formation of any detectable amounts of carcinogenic or mutagenic by-products, such as —NNO groups.

18 Claims, 8 Drawing Sheets

(51) Int. Cl.

| | |
|---|---|
| ***C06B 23/00*** | (2006.01) |
| ***C06B 25/20*** | (2006.01) |
| ***C06B 31/26*** | (2006.01) |
| *D03D 43/00* | (2006.01) |
| *C06B 25/00* | (2006.01) |
| *C06B 25/18* | (2006.01) |
| *C06B 25/24* | (2006.01) |

(56) References Cited

OTHER PUBLICATIONS

Marteau, Clementine, et al., "Dual Role of Phenols as Fragrances and Antioxidants: mechanism, kinetics and drastic solvent effect" Flavour and Fragrance Journal, Jan. 2013, pp. 30-38, vol. 28, No. 1, John Wiley & Sons, Ltd., Great Britian.

Kadoma, Yoshinori, et al., "Mechanisms of Cytotoxicity of 2- or 2,6-di-tert-butylphenols and 2-methoxyphenols in terms of inhibition rate constant and a theoretical parameter", Chemosphere, Feb. 2009, pp. 626-632, vol. 74, No. 5, Elsevier Ltd., Great Britain.

Naama, Jasim Hilo, et al., "Curcuminoids as antioxidants and theoretical study of stability of curcumin isomers in gaseous state", Research on Chemical Intermediates, Nov. 2013, pp. 4047-4059, vol. 39, No. 9, Springer, Netherlands.

Wilker, Stephan, et al., "Compatibility investigations of nitrate esters", Fraunhofer-Institut fuer Chemische Technologie, Jan. 1, 2000, Swisttal, Germany.

Chin, Anton, et al., "Investigation of the decomposition Mechanism and Thermal Stability of Nitrocellulose/Nitroglycerine Based Propellants by Electron Spin Resonance", Wiley InterScience, Propellants, Explosives, Pyrotechnics, Apr. 1, 2007, pp. 117-126, vol. 32, No. 2; Wiley-VCH Verlag GmbH & Co., KGaA, Weinheim, Germany.

NATO Standarization Agency, "Explosives, nitrocellulose-based propellants, stability test procedure and requirements using heat flow calorimetry", 24 pages, STANAG 4582, Ed. 1, North Atlantic Treaty Organisation, Brussels, Belgium.

International Search Report for corresponding PCT Application No. PCT/EP2014/071041 dated Apr. 15, 2015.

International Preliminary Report on Patentability and Written Opinion of the International Searching Authority for corresponding PCT Application No. PCT/EP2014/071041 dated Apr. 5, 2016.

* cited by examiner

STABILIZED NITROCELLULOSE-BASED PROPELLANT COMPOSITION

This application is a 371 application of PCT/EP2014/071041 filed Oct. 1, 2014, which claims foreign priority benefit under 35 U.S.C. § 119 of British Application No. GB 1317423.0 filed Oct. 2, 2013.

TECHNICAL FIELD

The present invention relates to stabilized nitrocellulose-based propellant compositions. In particular it concerns nitrocellulose-based propellant stabilized with a stabilizer producing little to no carcinogenic and mutagenic by-products.

BACKGROUND FOR THE INVENTION

Smokeless powders have been developed since the $19^{th}$ century to replace traditional gun powder or black powder, which generates substantial amounts of smoke when fired. The most widely used smokeless powders are nitrocellulose-based. Nitrocellulose is obtained by using nitric acid to convert cellulose into cellulose nitrate and water according to a general reaction:

$$3HNO_3+C_6H_{10}O_5 \rightarrow C_6H_7(NO_2)_3O_5+3H_2O$$

Nitrocellulose-based smokeless powder is then obtained by treating the thus obtained nitrocellulose by extrusion or spherical granulation, with or without solvent, two techniques which are well known to the persons skilled in the art.

Various improvements have been developed since the first discovery of nitrocellulose, by addition of further components, such as nitroglycerin and/or nitroguanadine allowing an increase of the detonation velocity. Pure nitrocellulose propellant is referred to as single-base propellant, and double- and triple-base propellants refer to compositions comprising nitrocellulose and one or two additional energetic bases, respectively, typically blasting oils such as nitroglycerin, nitroguanidine, or secondary explosives.

Nitrocellulose, as most nitrate esters, is prone to self-ignition as a result of thermal degradation due to the weakness of its O—N bond. When employed as an ingredient of propellants or other explosive compositions, the spontaneous ignition of nitrocellulose has caused serious accidents. It is obviously vital to inhibit or slow down this degradation for safety reasons but it is also important to retain the initial properties of the energetic composition. Degradation usually leads to gas emissions, heat generation and reduction of molecular mass affecting negatively the material structure and ballistic properties.

The decomposition of the nitrocellulose usually starts with a bond scission or hydrolysis, generating alkoxy radicals and nitrogen oxide (NOx) species (cf. FIG. 1). The radicals further react generating more radicals, speeding up the degradation process, and ultimately lead to chain scission accompanied by heat generation. In order to prolong the service life of the propellants, stabilizers are added to the energetic mixture in order to scavenge these radical species and slow down the degradation pattern.

All conventional stabilisers used to date for nitrocellulose-based propellants belong to (a) aromatic amines (e.g., diphenylamine, 4-nitro-N-methylamine) or (b) aromatic urea derivatives (e.g., akardite, centralite) and are or produce toxic and/or potentially carcinogenic species at some point during the propellant's lifetime. For example, the most widely used stabilizers to date are diphenyl amine, akardite, and centralite. These compounds, however, form carcinogenic derivatives such as N-nitrosodiphenylamine (cf. FIG. 2(*a*)) or N-nitrosoethylphenylamine.

Hindered amines, such as triphenylamine, reduce the formation of N—NO groups, but fail to stabilize nitrocellulose satisfactorily. Conventional hindered phenols used in the plastics industry have been tested and at short term stabilize nitrocellulose with little to no N—NO formation. The phenols are able to trap the alkoxy radicals generated during the degradation of nitrocellulose and thus form new, relatively stable alkoxy radicals, by delocalisation of an electron at the foot of electron-rich, hindered groups as illustrated in FIG. 2(*b*). The long term stability is, however, not always guaranteed, probably due to rapid phenol depletion and relative stability of the newly formed alkoxy radicals.

There thus remains in the field of solid propellants a need for stabilizers allowing long term stabilization of nitrocellulose-based propellants, fulfilling at least STANAG 4582 (Ed. 1) and which do not produce carcinogenic and/or mutagenic by-products. The present invention proposes a family of stabilizers fulfilling both above requirements. These and other advantages of the present invention are presented in continuation.

SUMMARY OF THE INVENTION

The present invention is defined in the appended independent claims. Preferred embodiments are defined in the dependent claims. In particular, the present invention concerns a nitrocellulose-based propellant composition comprising:

(a) a nitrate ester based propellant comprising nitrocellulose; and (b) a stabilizer consisting of a general formula (I):

(I)

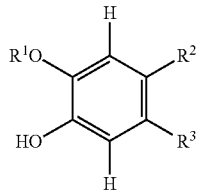

Wherein:

$R^1$ represents, alkyl substituted or not;

$R^2$ represents:

(i) H;

(ii) unsaturated alkyl group;

(iii)

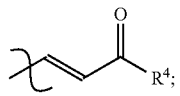

(iv)

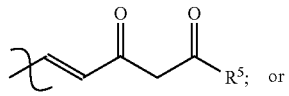

(v)

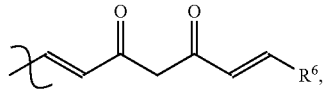

$R^3$ represents, H, alkyl substituted or not, or $OR^8$;

$R^4$ represents, alkyl substituted or not, aromatic ring substituted or not, or $OR^8$;

$R^5$ represents, alkyl substituted or not, aromatic ring substituted or not, or $OR^9$;

$R^6$ represents, aromatic ring substituted or not;

$R^7$ represents, alkyl substituted or not;

$R^8$ represents, alkyl substituted or not, or aromatic ring substituted;

$R^9$ represents, alkyl substituted or not, or aromatic ring substituted.

Unless otherwise specified, the expression "substituted or not" is to be construed as any —H in a molecule may be substituted by any of an alkyl, alkene, or an aromatic ring. The alkyl or alkene is preferably $C_1$-$C_9$, more preferably $C_2$-$C_5$. A propellant composition is considered as being a "nitrocellulose-based propellant composition" if it comprises at least 40 wt. % nitrocellulose, based on the total weight of the composition.

The nitrate ester based propellant may be a single base propellant consisting of nitrocellulose alone or, alternatively, may be a double or higher base propellant comprising nitrocellulose in combination with at least one blasting oil and/or at least one energetic additive. As known by a person skilled in the art, a blasting oil is herein defined as an energetic compound obtained by nitration of a polyol such as glycerol, glycol, diethylene glycol, triethylene glycol, metriol . . . . The obtained nitrate is most of the time heavy, oily and presents explosive properties. Nitroglycerin is probably the most common blasting oil employed in the industry. The term "NOx" is used herein in its generally recognized sense, as a generic term for mono-nitrogen oxides NO and $NO_2$ (nitric oxide and nitrogen dioxide). In a preferred embodiment the blasting oil comprises at least a nitrated polyol, said nitrated polyol is obtained by nitration of polyol selected from a group consisting of glycerol, glycol, diethylene glycol, triethylene glycol and metriol, preferably glycerol.

An energetic additive according to the present invention; like blasting oils, are used to enhance the blasting power of nitrocellulose. Energetic additives can be an energetic plasticizer or an explosive. Examples of energetic plasticizers comprise nitramines such as butyl-NENA or dinitrodiazaalkane (DNDA). Examples of explosives suitable for use as energetic additives include RDX, HMX, FOX7, FOX12, CL20.

The preferred stabilizers of the present invention are capable of reacting with radical alkoxy groups formed by degradation of the nitrate ester by H-abstraction to form a first by-product capable of reacting with NOx formed by degradation of the nitrate ester to form a second by-product comprising no NNO groups. It is even more preferred if the second by-product is itself also capable of reacting with radical alkoxy groups or with NOx formed by degradation of the nitrate ester forming third by-products. Optimally, the third and subsequent by-products are also capable of reacting with such radical alkoxy groups or with NOx, thus substantially prolonging the efficacy of the stabilizer.

It is preferred that the blasting oil comprises at least a nitrated polyol, said nitrated polyol is obtained by nitration of polyol selected from a group consisting of glycerol, glycol, diethylene glycol, triethylene glycol and metriol, preferably glycerol In a preferred embodiment, $R^1$ in formula (I) represents $C_{1-5}$ alkyl substituted or not, preferably $CH_3$. It is preferred that $R^2$ represents:

(i)

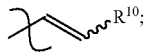

$R^{10}$;

(ii)

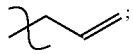

;

(iii)

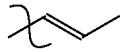

; or (iv)

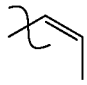

wherein $R^{10}$ represents H, alkyl substituted or not, or aromatic ring substituted or not.

In one embodiment, the stabilizer is curcumin derivative of formula (II):

(II)

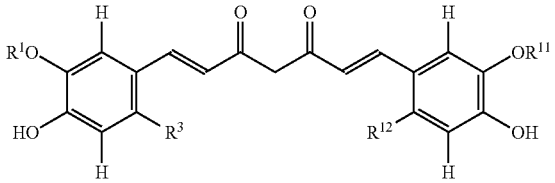

Wherein, $R^1$ and $R^{11}$ are same or different and represent alkyl substituted or not, preferably $C_{1-5}$ alkyl, more preferably $CH_3$;

$R^3$ and $R^{12}$ are same or different and represent H or alkyl substituted or not, each are preferably H, and wherein each of $R^1$ and $R^{11}$, and $R^3$ and $R^{12}$, are more preferably same.

The stabilizer of formula (II) is preferably a curcumin derivative of formula (IIa), wherein $R^1$ and $R^{11}$ are both $CH_3$; $R^2$ and $R^{12}$ are both OH; and $R^3$ and $R^{13}$ are both H.

(IIa)

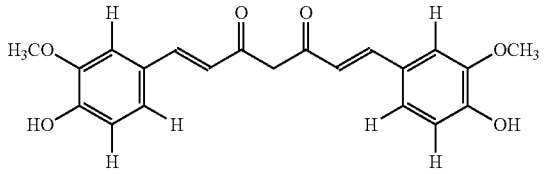

The stabilizer may be present in the composition in an amount comprised between 0.1 and 5.0 wt. %, preferably between 0.2 and 2.0 wt. %, more preferably between 0.5 and 1.5 wt. %, with respect to the total weight of the composition. The nitrate ester-based propellant may comprise nitrocellulose only, thus defining a single base propellant or, alternatively, it may comprise a blasting oil, such as nitroglycerin, to define a double base propellant. A double base propellant according to the present invention preferably comprises not more than 60 wt. % nitroglycerin, and preferably comprises between 5 and 45 wt. %, more preferably between 7 and 22 wt. % nitroglycerin, with respect of the total weight of nitrate ester based propellant.

The propellant compositions of the present invention should fulfil the stability requirements defined in STANAG 4582 (Ed. 1), namely generating less than 350 μW/g of heat flow for at least 3.43 days at a temperature of 90° C. Many propellant compositions of the present invention can achieve much better that this and may remain stable for over 30 days at 90° C.

Beside a nitrate ester based propellant and a stabilizer, the propellant compositions of the present invention may comprise additives. In particular, they may comprise one or more of the following additives:

(a) a potassium salt, such as potassium nitrate ($KNO_3$) or sulphate ($K_2SO_4$), preferably in an amount comprised between 0.01 and 1.5 wt. %;

(b) combustion moderators such as phthalates, Cl and citrate derivatives, preferably in an amount comprised between 1.0 and 10.0 wt. %;

(c) an anti-static agent such as graphite, preferably in an amount comprised between 0.01 and 0.5 wt. %; and (d) calcium carbonate, preferably in an amount comprised between 0.01 and 0.7 wt. %, Wherein the wt. % are expressed in terms of the total weight of the propellant composition.

The present invention also concerns the use of a stabilizer of formula (I) as defined above, for stabilizing a nitrocellulose-based propellant composition. The stabilizer is preferably of a formula (II), or (IIa) as defined supra.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
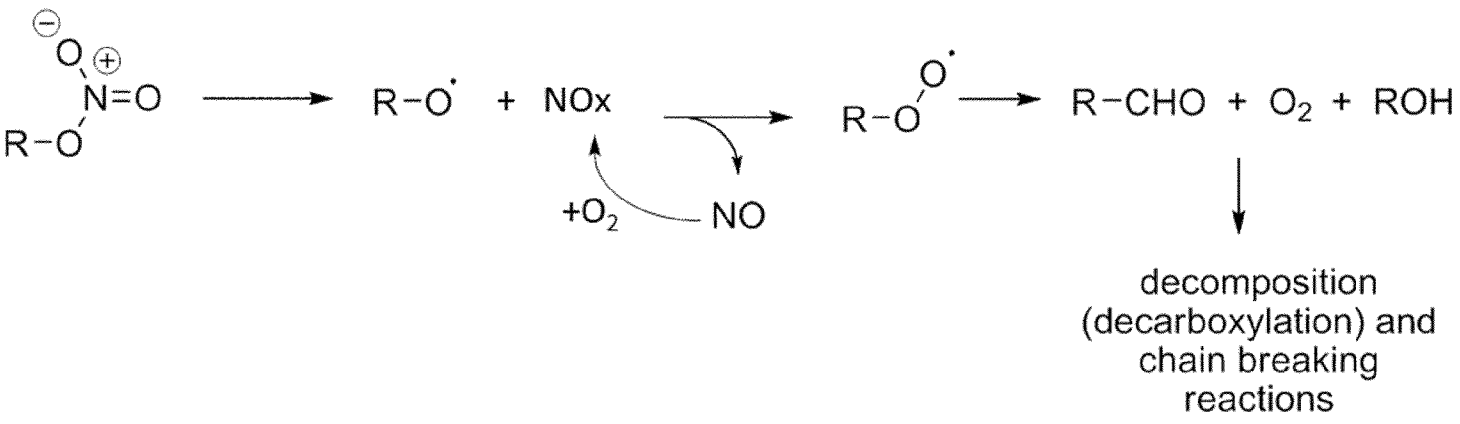
FIG. 1: shows a reaction of spontaneous decomposition of nitrocellulose with formation of free radicals and NOx.
Figure 2A:
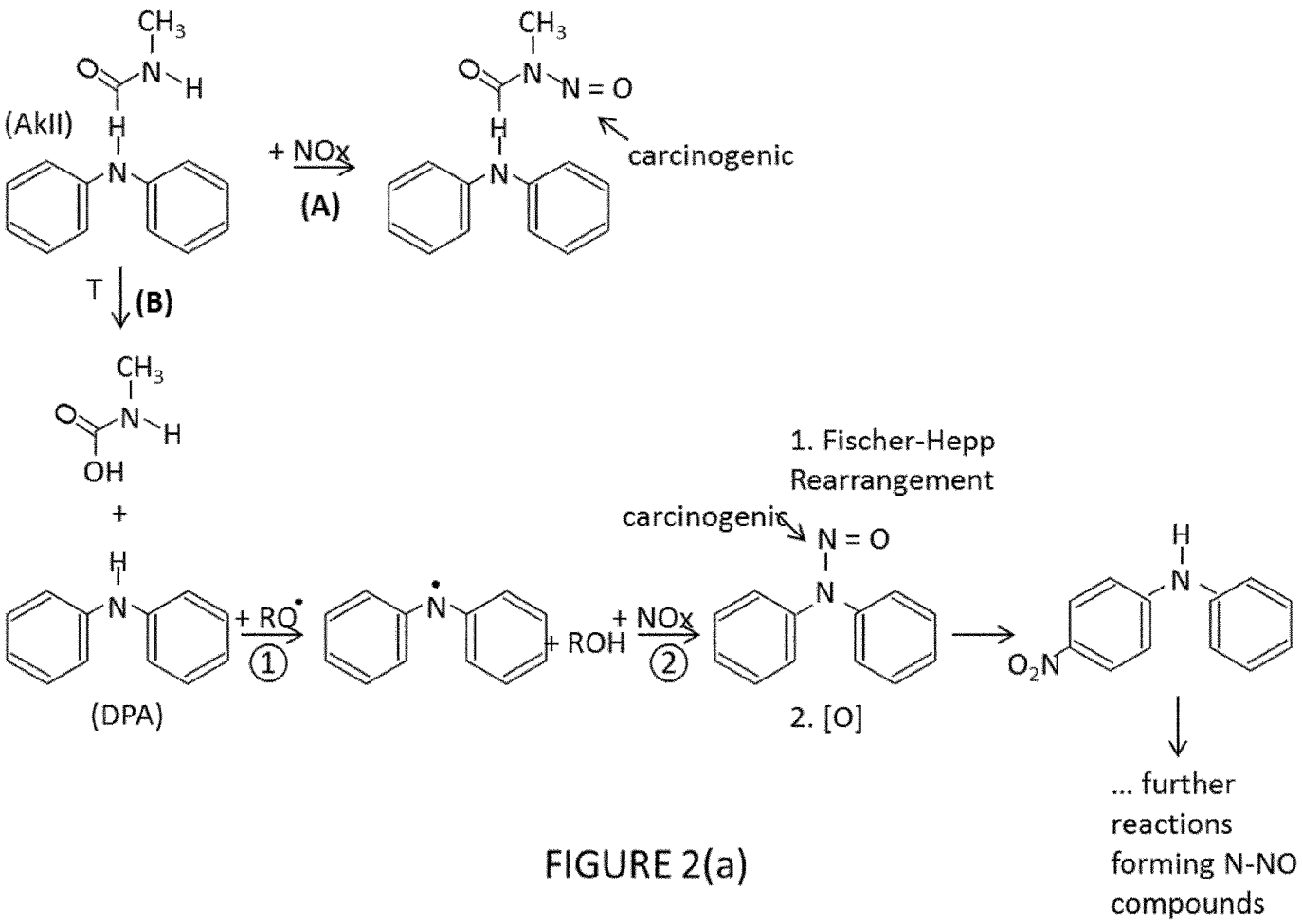
FIG. 2: shows assumed stabilization mechanisms of (a) akardite (AkII) and diphenylamine (DPA) (prior art), (b) a substituted trimethoxyphenol (prior art), and (c) and (d) stabilizers according to the present invention.
Figure 2B:
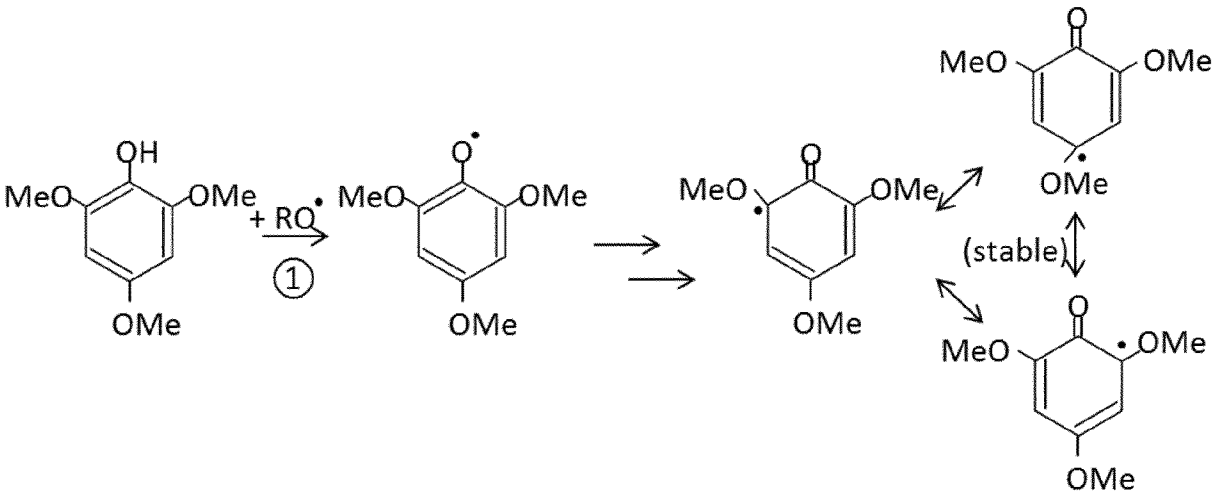
Figure 2D:
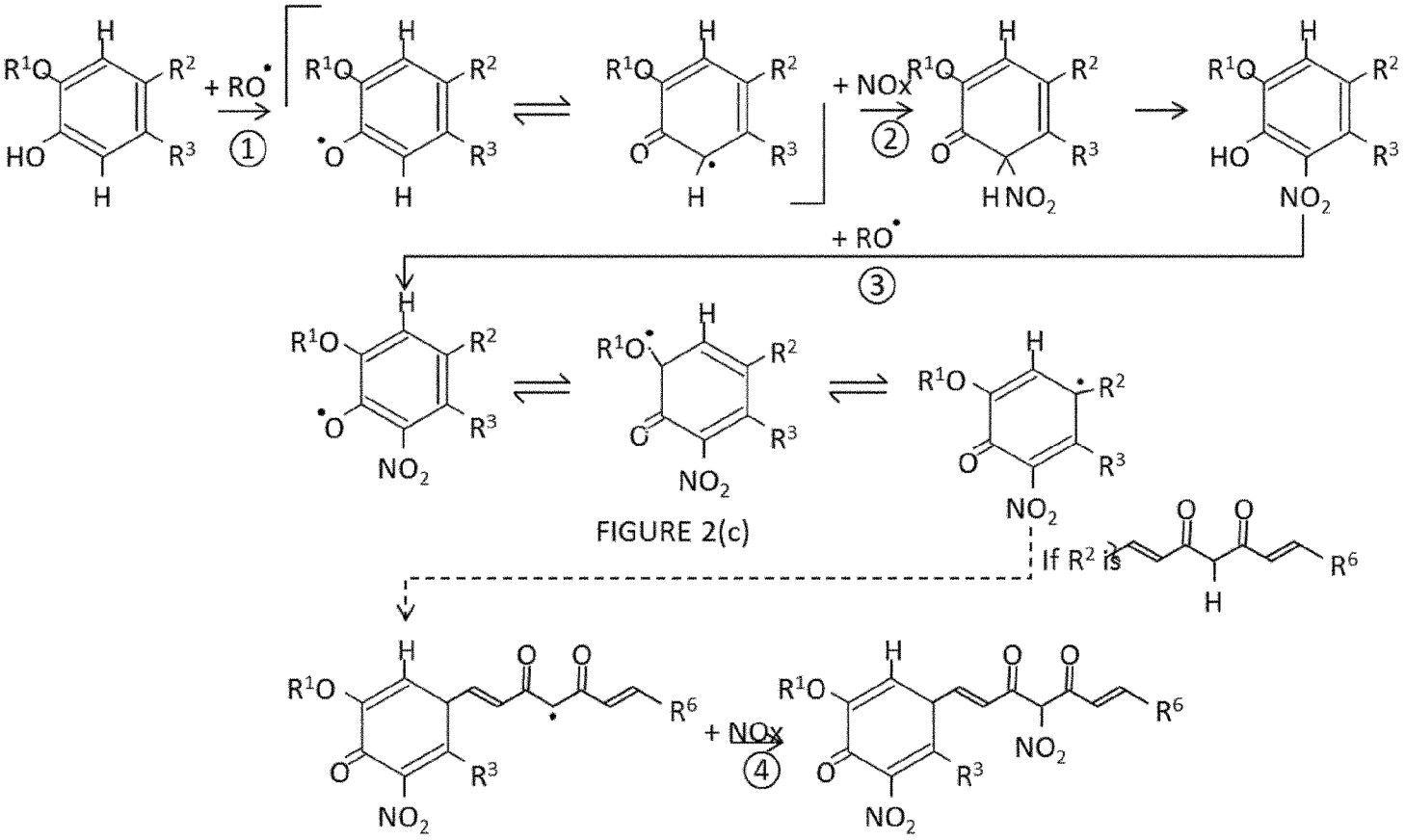

As illustrated in FIG. 1, degradation of nitrocellulose forms free oxide radicals (R—O) and NOx. These degradation products are capable of reacting further with nitrocellulose, which can rapidly lead to an explosion of the nitrate ester based propellant due to excess heat generation. The most commonly used stabilizers are certainly akardite (AkII) and diphenyl amine (DPA) as illustrated in FIG. 2(*a*). Akardite (AkII) when exposed to NOx, forms carcinogenic N—NO compounds as illustrated in reaction (A) of FIG. 2(*a*). Simultaneously or sequentially, it dissociates upon exposure to heat to form diphenyl amine (DPA) following reaction (B) of FIG. 2(*a*). Whether used directly as stabilizer, or present in the composition following heat dissociation (B) of akardite, diphenyl amine (DPA) stabilizes a propellant composition by the following mechanism. A free radical alkoxy group generated by the propellant abstracts the hydrogen of the amine group of DPA to form a stable compound (ROH) (cf. reaction ① of FIG. 2(*a*)). The radical formed on the amine can react with a NOx to form stable N-nitrosodiphenylamine (cf. reaction ② of FIG. 2(*a*)). The NNO group of N-nitrosodiphenylamine is, however, carcinogenic and should be avoided for safety reasons. Triphenylamine has been tested in the past in order to prevent formation of NNO groups, but with little success in stabilization properties. Hindered phenols as illustrated in FIG. 2(*b*) effectively react with free oxide radicals (R—O) but forming stable components which are unlikely to further react with NOx (cf. reaction ① of FIG. 2(*b*)). The efficacy of such stabilizers is limited to short periods of time only because of rapid phenols depletion.

A stabilizer as used in the present invention has a general formula (I)

(I)

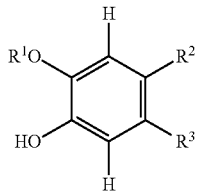

Wherein:

$R^1$ represents, alkyl substituted or not;

$R^2$ represents:

(i) H;

(ii) unsaturated alkyl group;

(iii)

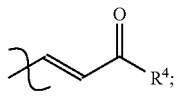

(iv)

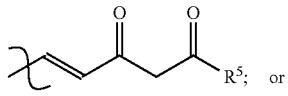

(v)

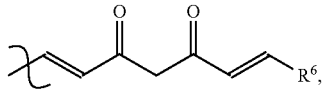

$R^3$ represents, H, alkyl substituted or not, or $OR^8$;

$R^4$ represents, alkyl substituted or not, aromatic ring substituted or not, or $OR^8$;

$R^5$ represents, alkyl substituted or not, aromatic ring substituted or not, or $OR^9$;

$R^6$ represents, aromatic ring substituted or not;

$R^7$ represents, alkyl substituted or not;

$R^8$ represents, alkyl substituted or not, or aromatic ring substituted;

$R^9$ represents, alkyl substituted or not, or aromatic ring substituted.

Not wishing to be bound by any theory, it is believed that a stabilizer as defined in the present invention reacts as illustrated in FIG. 2(*c*) by first neutralising a radical alkoxy group by H-abstraction to form a radical capable of reacting with NOx by delocalization of the radical within the aryl ring (cf. reactions ①&② of FIG. 2(*c*)). At this stage, the invention has already solved a first problem of providing a stabilizer capable of stabilizing a nitrocellulose-based propellant at least as efficiently as diphenylamine, without generating NNO-groups. It is believed, however, that the stabilizers of the present invention yield by-products capable, after tautomerization, of further reacting according to a second and possibly further cycles with further radical alkoxy groups and NOx, thus substantially prolonging the stabilizing action of the stabilizers. For example, in case $R^2$ represents a moiety of the type,

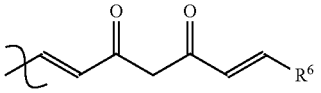

FIG. 2(*d*) shows, after reaction ②, neutralisation of a further radical by H-abstraction to form a further radical (cf. reaction ③ of FIG. 2(*d*), allowing further reaction with a NOx as illustrated in reaction ④ of FIG. 2(*d*). Alternatively or concomitantly, the reaction may proceed with further reaction with a NOx molecule. The numerous reactions of neutralisation of NOx or radicals present in the composition allow a substantial reduction of the exothermic reaction represented in FIG. 1, so that the composition stability is substantially enhanced.

In a preferred embodiment, $R^1$ represents $C_{1-5}$ alkyl substituted or not, preferably $CH_3$; Further, it is preferred that $R^2$ represents:

(i)

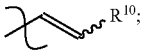

(ii)

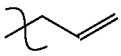

(iii)

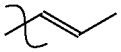

(iv)

Figure 5:
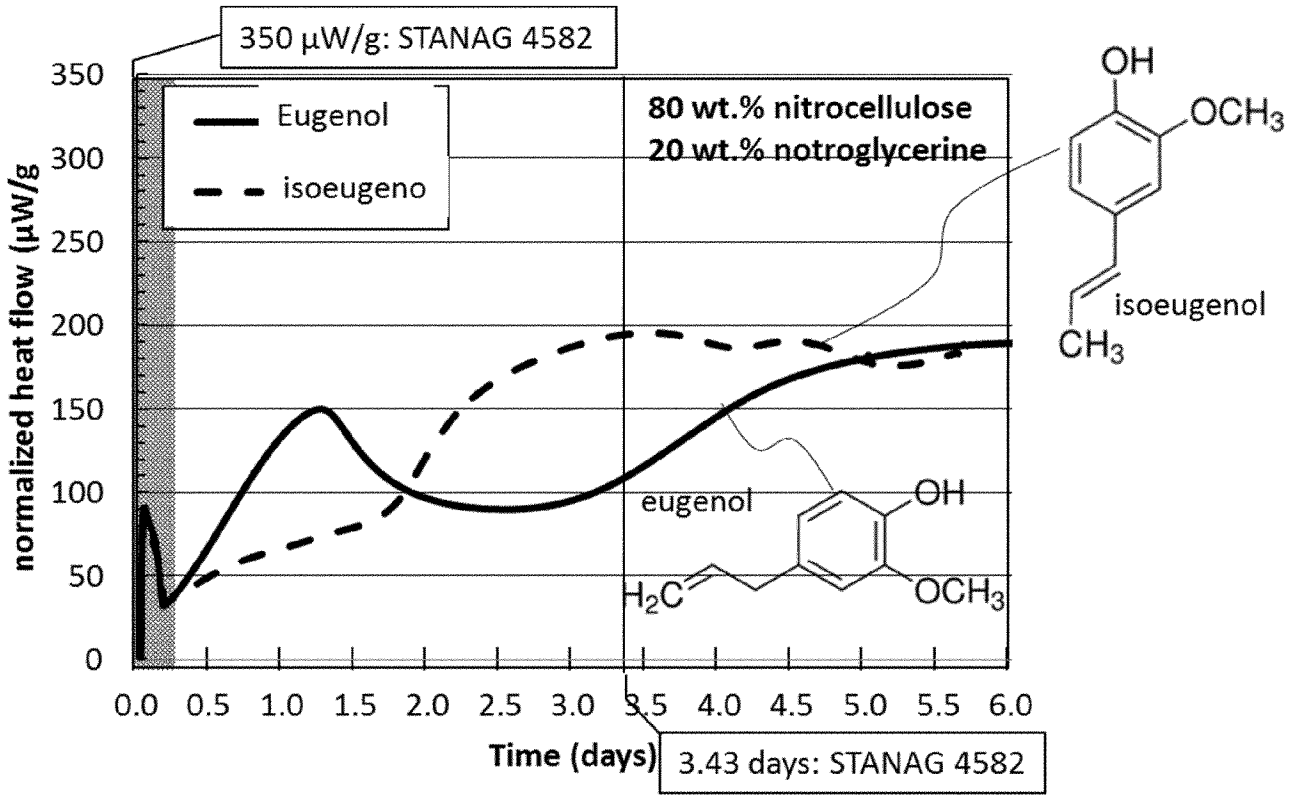
FIG. 5: shows the normalized heat flow expressed in μW/g generated by a double base propellant comprising 80 wt. % nitrocellulose and 20 wt. % nitroglycerin stabilized with two stabilizers according to the present invention: eugenol (III) and isoeugenol (IV)

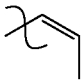

wherein $R^{10}$ represents H, alkyl substituted or not, or aromatic ring substituted or not. For example, eugenol (III) or isoeugenol (IV) are suitable stabilizers according to the present invention as shown in FIG. 5:

(III)

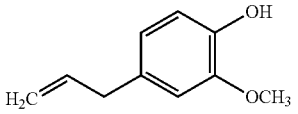

eugenol

-continued (IV)

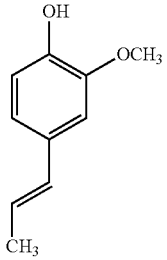

isoeugenol

A most preferred embodiment of composition according to the present invention comprises a curcumin derivative of formula (II) as stabilizer.

(II)

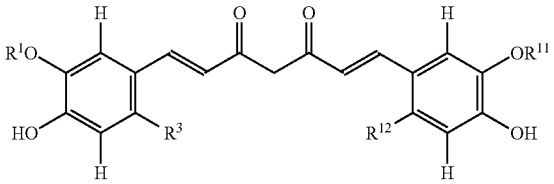

wherein $R^1$ and $R^{11}$ are same or different and represent alkyl substituted or not, preferably $C_{1-5}$, more preferably $CH_3$;

$R^3$ and $R^{12}$ are same or different and represent H or alkyl substituted or not (e.g., $C_{1-5}$ alkyl), wherein each of $R^1$ and $R^{11}$, and $R^3$ and $R^{12}$, are preferably same, and more preferably both are H.

Figure 3:
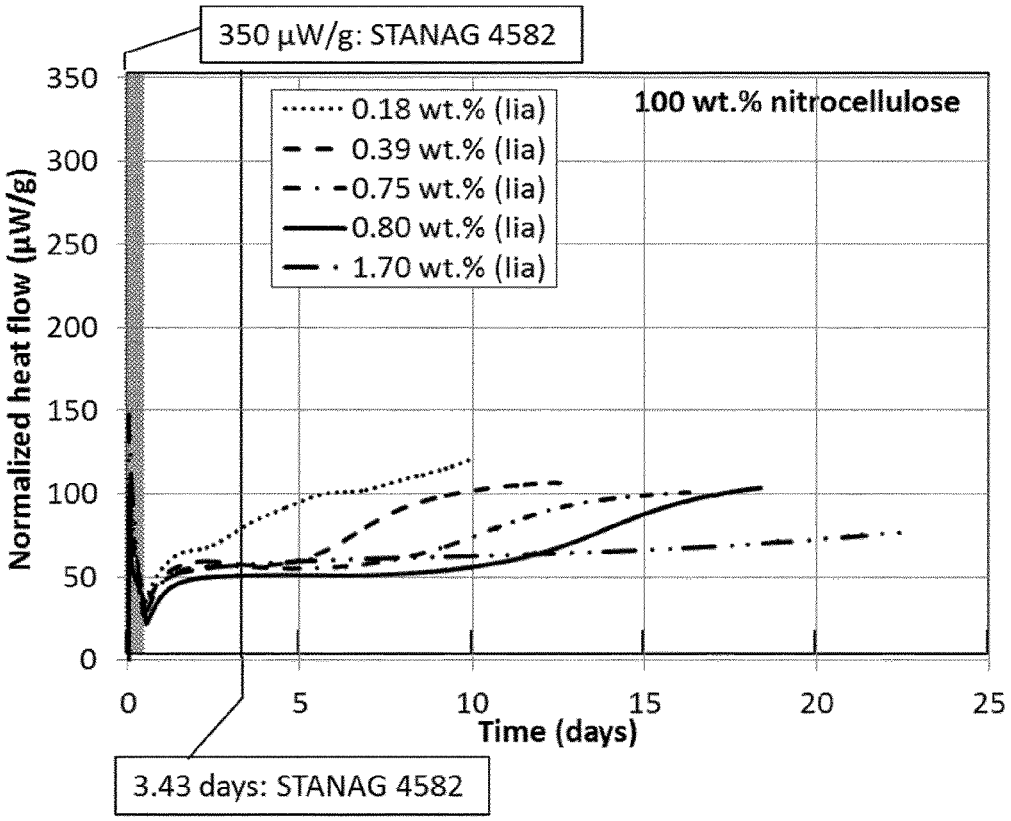
FIG. 3: shows the normalized heat flow expressed in μW/g generated by propellant compositions stabilized with various amounts of a stabilizer of formula (IIa) for (a) single base nitrocellulose propellants and (b) double base nitrocellulose/nitroglycerin (90/10 wt. %) propellants.
Figure 3:
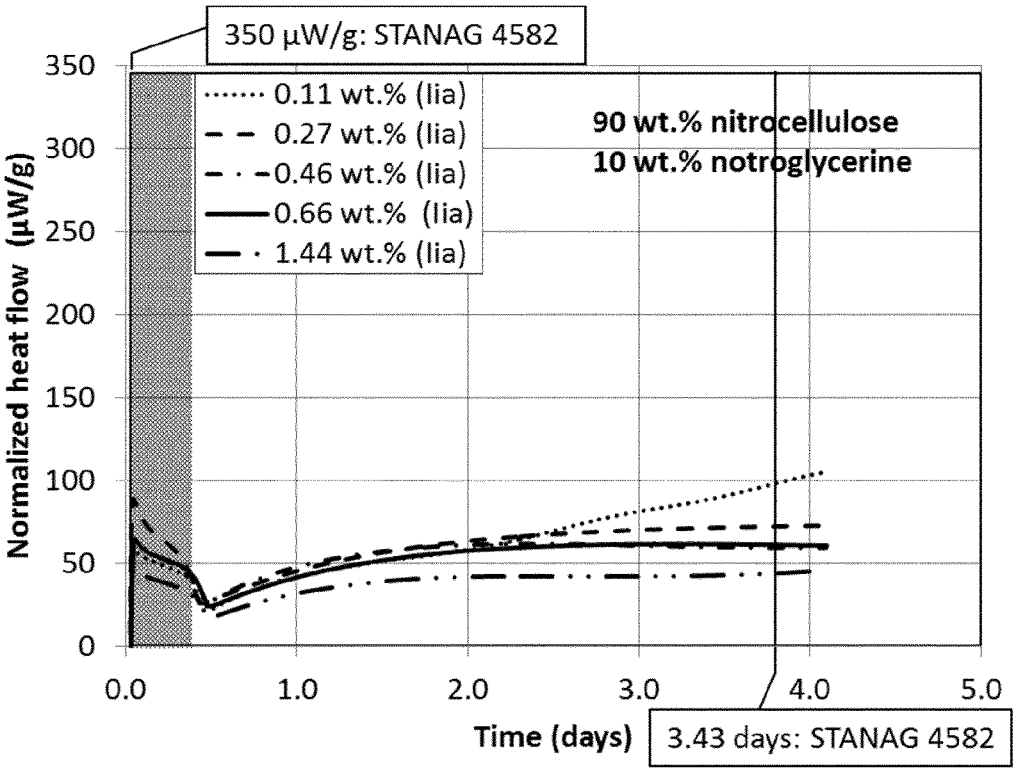
Figure 4:
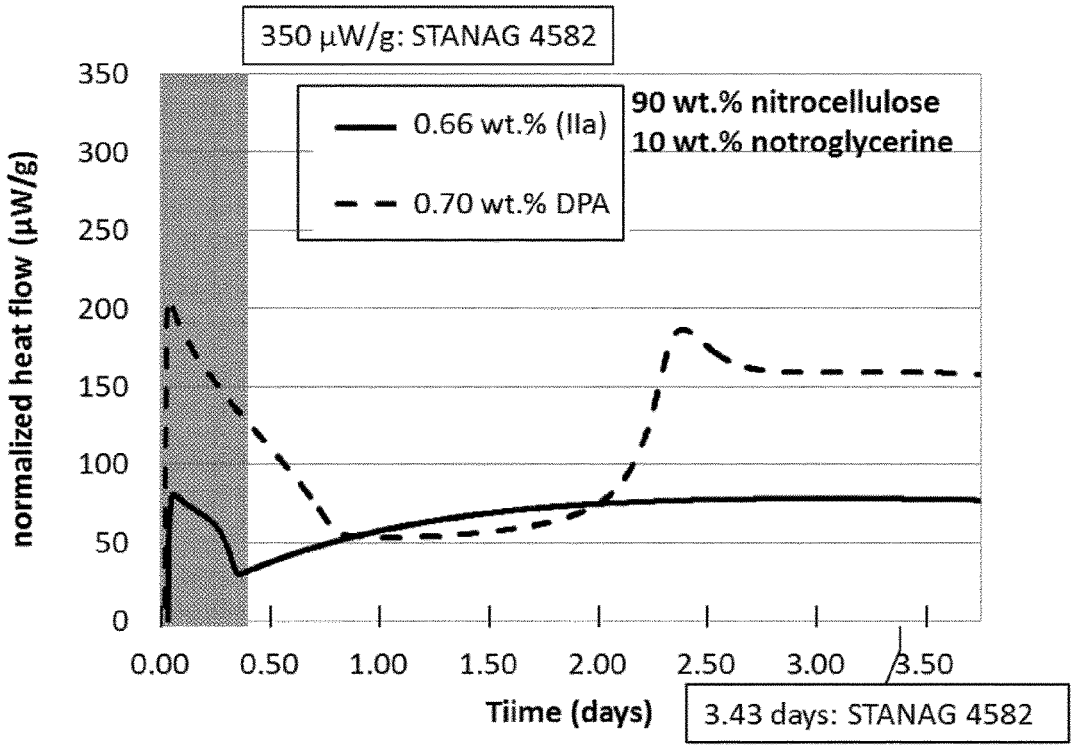
FIG. 4: shows the normalized heat flow expressed in μW/g generated by a double base propellant comprising 90 wt. % nitrocellulose and 10 wt. % nitroglycerin stabilized with 0.66 wt. % of a stabilizer of formula (IIa) according to the present invention (solid line) and with 0.70 wt. % diphenyl amine (DPA) of the prior art (dashed line).

In particular a stabilizer of formula (IIa) yields excellent stabilisation properties as illustrated in FIGS. 3 and 4 which are discussed in continuation.

(IIa)

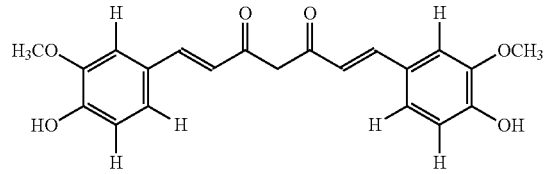

The propellant composition may be a simple base propellant, wherein the nitrate ester propellant consists of nitrocellulose only or a double base propellant, wherein nitrocellulose is combined with a blasting oil and/or at least one energetic additive. The most common blasting oil is nitroglycerin. FIG. 3(*a*) illustrates the stability of a simple base propellant composition stabilized with various amounts of a stabilizer (IIa) according to the present invention. FIG. 3(*b*) illustrates the same for a double base propellant composition wherein the nitrate ester propellant comprises 90 wt. % nitrocellulose and 10 wt. % nitroglycerin, a commonly used blasting oil. Energetic additives, on the other hand, can be an energetic plasticizer selected from the group of nitramines such as butyl-NENA, dinitrodiazaalkane (DNDA), or an explosive such as RDX, HMX, FOX7, FOX12, CL20. A double base propellant composition according to the present invention preferably comprises a nitrate ester based propellant comprising not more than 60 wt. % blasting oil (such as nitroglycerin) or energetic additive with respect to the total weight of nitrate ester based propellant. More preferably, it comprises between 5 and 45 wt. %, most preferably between 7 and 22 wt. % blasting oil or energy additive, with respect of the total weight of nitrate ester based propellant. A most preferred blasting oil is nitroglycerin.

A propellant composition according to the present invention comprises a stabilizer of formula (I), preferably in an amount comprised between 0.1 and 5.0 wt. %, more preferably between 0.2 and 2.0 wt. %, most preferably between 0.5 and 1.5 wt. %, with respect to the total weight of the composition. FIGS. 3(*a*) and 4(*a*) illustrate the stability of a single base and a double base propellant composition, respectively, stabilized with various amounts of a stabilizer according to formula (IIa). Although it is generally considered that a propellant composition cannot be satisfactorily stabilized with less than 1 wt. % stabilizer, it can be seen in FIGS. 3(*a*) and 4(*a*) that excellent stability results are already obtained with as little as 0.11 wt. % stabilizer of formula (IIa).

Beside a nitrate ester based propellant and a stabilizer, a propellant composition according to the present invention may comprise additives. In particular, it may comprise one or more of the following additives:

(a) a potassium salt, such as potassium nitrate ($KNO_3$) or sulphate ($K_2SO_4$), preferably in an amount comprised between 0.01 and 1.5 wt. %;

(b) combustion moderators such as phthalates, centralite and citrate derivatives, preferably in an amount comprised between 1.0 and 10.0 wt. %;

(c) an anti-static agent such as graphite, preferably in an amount comprised between 0.01 and 0.5 wt. %; and (d) calcium carbonate, preferably in an amount comprised between 0.01 and 0.7 wt. %, Wherein the wt. % are expressed in terms of the total weight of the propellant composition.

An example of propellant composition according to the present invention is listed in Table 1.

TABLE 1 typical propellant compositions according to the present invention

| component | single base wt. % | double base wt. % |
|---|---|---|
| nitrocellulose | 89.0-96.0 | 82.0-86.0 |
| nitroglycerin | 0.0 | 7.0-11.0 |
| $K_2SO_4$ | 0.5-1.0 | 0.5-1.0 |
| dibuthylphthalate | 3.0-7.0 | 3.0-7.0 |
| graphite | 0.2-0.4 | 0.2-0.4 |
| calcium carbonate | <0.7 | <0.7 |
| stabilizer of formula (I) | 0.15-2.0 | 0.15-2.0 |

Experimental Tests

STANAG 4582 (Ed. 1) of Mar. 9, 2007 entitled "*Explosives, nitrocellulose-based propellants, stability test procedure and requirements using heat flow calorimetry*", defines an accelerated stability test procedure for single-, double-, and triple base propellants using heat flow calorimetry (HFC). The test is based on the measurement of the heat generated by a propellant composition at a high temperature. Fulfillment of the STANAG 4582 (Ed. 1) test qualifies a propellant composition for a 10 year stability at 25° C.

A sample of propellant composition is enclosed in a hermetically sealed vial and positioned in a heat flow calorimeter having a measuring range corresponding to 10 to 500 μW/g. The sample is heated and maintained at a constant temperature of 90° C. for the whole duration of the test and the heat flow is measured and recorded. A heat flow not exceeding 350 μW/g for a period of 3.43 days at 90° C. is considered to be equivalent to at least 10 years of safe storage at 25° C. The graphs of FIGS. 3 to 5 are plots of such measurements. The full scale of the ordinate (normalized heat flow) corresponds to a value of 350 μW/g not to be exceeded according to STANAG 4582 (Ed. 1), and the vertical straight line indicates 3.43 days. The initial heat flow peak comprised within the shaded area of the graphs of FIGS. 3 to 5 is ignored as it is not representative of any specific reaction or phase transformation of the propellant composition, provided it does not exceed an exotherm of 5 J.

FIGS. 3(*a*)&(*b*) show the results of the stability tests carried out on a single- and double-base nitrocellulose-based propellants, the latter comprising 10 wt. % nitroglycerin for various amounts of a stabilizer according to formula (IIa) comprised between 0.10 and 1.70 wt. %, with respect to total weight of the propellant composition. It can be seen that even with as little as 0.11 wt. % stabilizer the heat flow never exceeds 100 μW/g for 3.43 days, when STANAG 4582 (Ed. 1) requires to maintain the heat flow below 350 μW/g (full scale of the ordinate). The tests on single base propellants were carried out for a longer period, showing a prolonged stability of the compositions with a heat flow continuously lower than 150 μW/g for over 20 days.

FIG. 4 compares the stability of double-base propellant compositions stabilized with, on the one hand, 0.66 wt. % of the stabilizer of formula (IIa) according to the present invention (solid line) and, on the other hand, with diphenyl amine (DPA) of the prior art (dashed line). It can be seen that both stabilizers (Stabilizer (IIa) and DPA) fulfil the requirements of STANAG 4582 (Ed. 1), The stabilizer (IIa) according to the present invention is advantageous over DPA because, (a) Contrary to DPA, stabilizers according to the present invention do not generate any N—NO carcinogenic by-product upon their stabilization activity, and (b) DPA curve (dashed line) shows a sharp peak stabilizing in a plateau at higher heat flow values, suggesting that all DPA was spent after only about two days (cf. reactions ①&② in FIG. 2(*a*)) whence stabilization probably proceeds by reactions with by-products. By contrast, no discontinuity in the heat flow can be identified with stabilizer (IIa) over 3.5 days. and even for over 20 days, as revealed in FIG. 3(*a*) discussed supra with respect to single base nitrocellulose propellants.

(c) As revealed in FIG. 3(*a*) discussed supra with respect to single base nitrocellulose propellants, the stabilizers of the present invention allow the maintenance of a heat flow substantially lower than 350 μW/g at a temperature of 90° C. for periods well over 20 days. Longer term tests with DPA, however, are not easily performed because vials containing a composition stabilized with DPÄ or AkII leaked earlier than the ones stabilized according to the present invention. It is assumed that gas generation by the reactions with DPA raises the pressure inside the vials above their limit of resistance, leading to the bursting open of the vials after a few days testing. Uncontrolled pressure rises must be avoided during transportation or storage of propellant compositions for obvious reasons.

FIG. 5 shows the stability curves of two further embodiments of the present invention, eugenol of formula (III) (CAS: 97-53-0) and isoeugenol of formula (IV) (CAS: 97-54-1) which, like the curcumin derivative of formula (IIa—stabilizes well beyond 3.43 days a double base propellent composition composed of 80 wt. % nitrocellulose and 20 wt. % nitrocellulose maintained at a temperature of 90° C., thus fulfilling STANAG4582 without generating any NNO carcinogenic components.

The propellant compositions of the present invention mark the beginning of the use of a new generation of stabilizers which can be referred to as "green stabilizers," which combine efficient, long term stability of nitrocellulose-based propellants without formation of any detectable amounts of carcinogenic or mutagenic by-products.

The invention claimed is:

1. A nitrocellulose-based propellant composition comprising (a) a nitrate ester based propellant, and (b) a stabilizer consisting of a general formula (I):

(I)

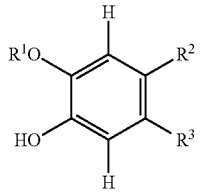

wherein:

$R^1$ represents, alkyl substituted or not;

$R^2$ represents:

(i) H;

(ii) unsaturated alkyl group;

(iii)

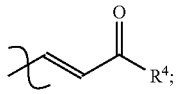

(iv)

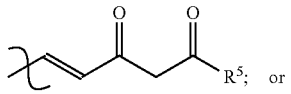

or (v)

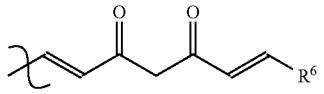

$R^3$ represents, H, alkyl substituted or not, or $OR^8$;

$R^4$ represents, alkyl substituted or not, aromatic ring substituted or not, or $OR^8$;

$R^5$ represents, alkyl substituted or not, aromatic ring substituted or not, or $OR^9$;

$R^6$ represents, aromatic ring substituted or not;

$R^7$ represents, alkyl substituted or not;

$R^8$ represents, alkyl substituted or not, or aromatic ring substituted;

$R^9$ represents, alkyl substituted or not, or aromatic ring substituted.

2. The propellant composition according to claim 1, wherein the nitrate ester based propellant is a single base propellant consisting of nitrocellulose alone or is a double or higher base propellant comprising nitrocellulose in combination with at least one blasting oil and/or at least one energetic additive.

3. The propellant composition according to claim 1, wherein the stabilizer is a substance capable of reacting by H-abstraction with radical alkoxy groups formed by degradation of the nitrate ester to form a first by-product capable of reacting with NOx formed by degradation of the nitrate ester to form a second by-product comprising no NNO groups.

4. The propellant composition according to claim 3, wherein the second by-product is capable of reaction with radical alkoxy groups or with NOx formed by degradation of the nitrate ester for forming third and subsequent by-products capable of reacting with such radical alkoxy groups or with NOx.

5. The propellant composition according to claim 2, wherein the at least one blasting oil comprises at least a nitrated polyol, said nitrated polyol is obtained by nitration of polyol selected from a group consisting of glycerol, glycol, diethylene glycol, triethylene glycol and metriol, and wherein the at least one energetic additive is an energetic plasticizer selected from the group of nitramines or is an explosive.

6. The propellant composition according to claim 1, wherein $R^1$ represents G-s alkyl substituted or not.

7. The propellant composition according to claim 1, wherein $R^2$ represents:

(v)

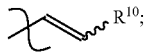

(vi)

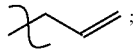

(vii)

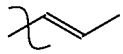

or (viii)

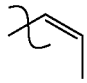

wherein $R^{10}$ represents H, alkyl substituted or not, or aromatic ring substituted or not.

8. The propellant composition according to claim 7, wherein the stabilizer is eugenol of formula (II) or isoeugenol of formula (IV):

(III)

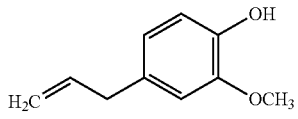

(IV)

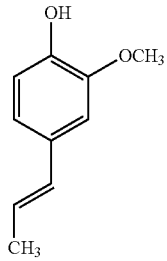

9. The propellant composition according to claim 1, wherein the stabilizer is of formula (II):

(II)

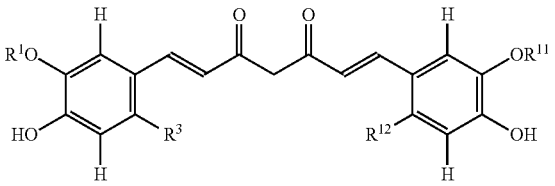

wherein $R^1$ and $R^{11}$ are same or different and represent alkyl substituted or not, preferably alkyl;

$R^3$ and $R^{12}$ are same or different and represent H or alkyl substituted or not.

10. The propellant composition according to claim 9, wherein the stabilizer is of formula (IIa)

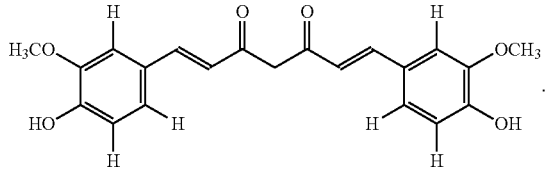

11. The propellant composition according to claim 1, wherein the stabilizer is present at an amount between 0.1 and 5.0 wt. %, with respect to the total weight of the propellant composition.

12. The propellant composition according to claim 1, wherein the nitrate ester based propellant comprises not more than 60 wt. % nitroglycerin, with respect of the total weight of nitrate ester based propellant.

13. The propellant composition according to claim 1, wherein the propellant composition has stability measured according to STANAC 4582 (Ed. 1) at a temperature of 90° C. without heat flow generation above 350 μvv/g for at least 3.43 days.

14. The propellant composition according to claim 1, further comprising one or more of the following additives:

(a) a potassium salt comprising potassium nitrate (KNO3) or sulphate (K2SO4), in an amount comprised between 0.01 and 1.5 wt. %;

(b) combustion moderators comprising phthalates, Cl and citrate derivatives, in an amount comprised between 1.0 and 10.0 wt. %;

(c) an anti-static agent comprising graphite, in an amount comprised between 0.01 and 0.5 wt. %; and (d) calcium carbonate in an amount comprised between 0.01 and 0.7 wt. %, Wherein the wt. % are expressed in terms of the total weight of the propellant composition.

15. The propellant composition according to claim 5, wherein the polyol consists of glycerol, and the energetic plasticizer is selected from the group consisting of butyl-NENA and dinitrodiazaalkane or the explosive is selected from the group consisting of RDX, HMX, FOX7, FOX12 and CL20.

16. The propellant composition according to claim 6, wherein $R^1$ represents $CH_3$.

17. The propellant composition according to claim 11, wherein the stabilizer is present at an amount between 0.5 and 1.0 wt. %, with respect to the total weight of the propellant composition.

18. The propellant composition according to claim 12, wherein the nitrate ester based propellant comprises nitroglycerin at an amount between 7 and 22 wt. %, with respect of the total weight of nitrate ester based propellant.

* * * * *